United States Patent [19]

Kremer

[11] Patent Number: 4,591,109

[45] Date of Patent: May 27, 1986

[54] WIRE DISPENSING MULTI-SPOOL PROTECTIVE HOLDER

[76] Inventor: Stephen H. Kremer, R.R. #3, Monticello, Iowa 52310

[21] Appl. No.: 718,527

[22] Filed: Apr. 1, 1985

[51] Int. Cl.[4] ..... B65H 49/16

[52] U.S. Cl. ..... 242/129; 242/129.62

[58] Field of Search ..... 242/55.3, 128, 129.5, 242/129.6, 129.62, 134–138, 86.5 R; 225/34, 46, 47; 211/59

[56] References Cited

U.S. PATENT DOCUMENTS

| | | | |
|---|---|---|---|
| 3,061,235 | 10/1962 | Lingle | 242/128 |
| 3,367,589 | 2/1968 | Chant, Jr. et al. | 242/55.3 |
| 4,385,738 | 5/1983 | McDonald | 242/129.6 |

*Primary Examiner*—John M. Jillions

*Attorney, Agent, or Firm*—Warren H. Kintzinger

[57] ABSTRACT

A wire dispensing multi-spool holder with duplicate opposite side spaced parallel rectangular support frame members. The rectangular support frame members are aligned and are structurally interconnected by four transverse spacing bars welded at opposite ends to the middle of the respective sides of the support frame members. Each of the respective rectangular support frame members, that are formed of strong tubing and have rounded corners, are provided with flat stock plank like members, thinner than the tubing of the frame members, that span the space between two opposite sides thereof and are welded at the ends to the transverse thickness middle of the frame member tubing. The comparative thickness of the flat stock plank like members are typically ⅛ inch thick stock welded to ¾ inch diameter tubing. Two of the flat stock plank like members are provided in spaced parallel coplanar relation in each rectangular support frame member and have two spaced openings in each flat stock plank like member to receive and support respective ends of wire spool mounting rods spanning the space between flat stock plank like members of the spaced parallel opposite side rectangular support frame members. This provides for four wire spool mounting rods to be supported in spaced parallel relation such that wire spools mounted thereon up to spool diameters the wire dispensing multi-spool holder is designed to mount are supported between the opposite side rectangular support frame members and entirely within the projected protective profile thereof.

11 Claims, 10 Drawing Figures

WIRE DISPENSING MULTI-SPOOL PROTECTIVE HOLDER

Figure 1:
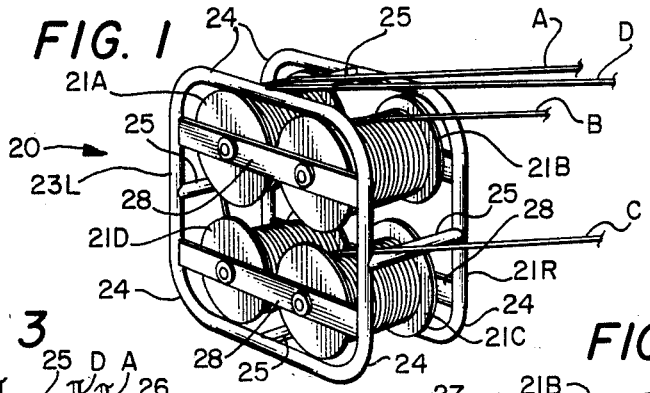

This invention relates in general to wire reel and drum racks, and more particularly, to a wire dispensing multi-spool protective holder.

Most wire reel and drum holders or racks have portions of reels or drums projecting out beyond the profile of rack structure exposed to damage from other equipment being used in the vicinity. Furthermore, many wire reel or drum or spool mounting structures are heavy, awkward and hard to move structures that are also, in many instances, unduly expensive. Smoothness of wire feed operation is also an important matter with wire and spools protected while being readily and quickly replaceable when a spool is run out. Another problem with many of the preexisting wire spool units is that of storage space requirements along with damaged wire and broken spools particularly during transportation. Light weight units that can be stacked or stored side by side efficiently are very much desired as well as units that are structurally strong yet relatively light for easy safe movement when desired to speed up wire pulling operations.

It is therefore a principal object fo this invention to provide a wire dispenser that protects wire and spools from damage to wires or breakage of spools during storage and during transporting of the wire dispensers.

Another object is to provide such a wire dispenser capable of handling 500 foot wire spools up to 7 inch diameter in wire gauge from number 22 to number 10.

A further object is to provide such a wire dispenser that is ideal for pulling control wire in a unit that is light weight yet strong.

Still another object is to provide a wire dispenser that can be easily ganged for the pulling of large numbers of control wires or building wires.

Another object is to provide such wire dispensers that are quick to set up and smooth operating that can be stacked or stored side by side.

Features of the invention useful in accomplishing the above objects include, in a wire dispensing multi-spool protective holder, duplicate opposite side spaced parallel rectangular support frame members. The rectangular support frame members are aligned and are structurally interconnected by four transverse spacing bars welded at opposite ends to the middle of the respective sides of the support frame members. Each of the respective rectangular support frame members, that are formed of strong tubing and have rounded corners, are provided with flat stock plank like members thinner than the tubing of the frame members, that span the space between two opposite sides thereof that are welded at the ends to the transverse thickness middle of the frame member tubing. The comparative thickness of the flat stock plank like members are typically $\frac{1}{8}$ inch thick stock welded to $\frac{3}{4}$ inch diameter tubing. Two of the flat stock plank like members are provided in spaced parallel coplanar relation in each rectangular support frame member and have two spaced openings in each flat stock plank like member to receive and support respective ends of wire spool mounting rods spanning the space between flat stock plank like members of the spaced parallel opposite side rectangular support frame members. This provides for four wire spool mounting rods to be supported in spaced parallel relation such that wire spools mounted thereon up to spool diameters the wire dispensing multi-spool holder is designed to mount are supported between the opposite side rectangular support frame members and entirely within the projected protective profile thereof. The wire spool mounting rods are provided with a pressed on washer (or flange) at one end and with an easily disengageable locking pin at the other end for convenient removal of empty spools and replacement mounting of full wire spools on the spool mounting rods as required. Further, the washer or flange at one end of each wire spool mounting rod and the locking pin at the other end are thin enough that mounting rod end projection is less than the dimension from the outer face of each flat stock plank like member and the outermost extent of the respective side rectangular support frame member.

Specific embodiments representing what are presently regarded as the best modes of carrying out the invention are illustrated in the accompanying drawings.

Figure 3:
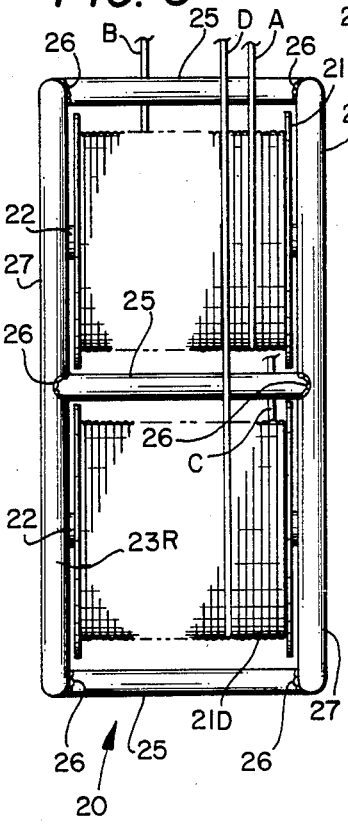
Figure 2:
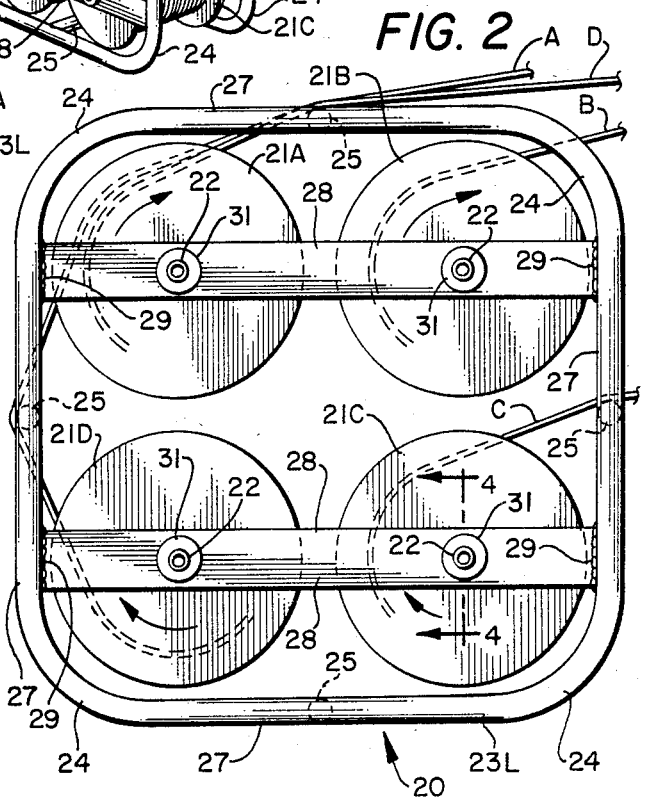
Figure 4:
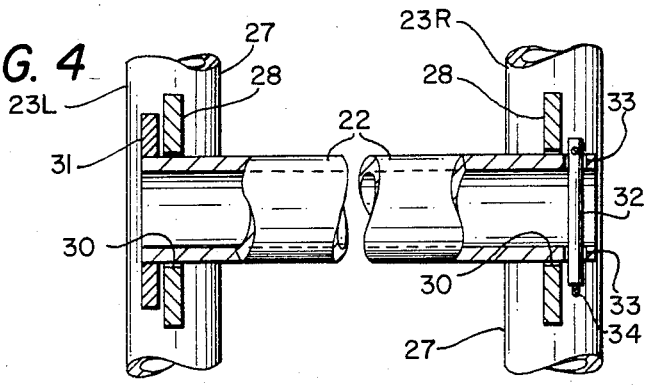
Figure 5:
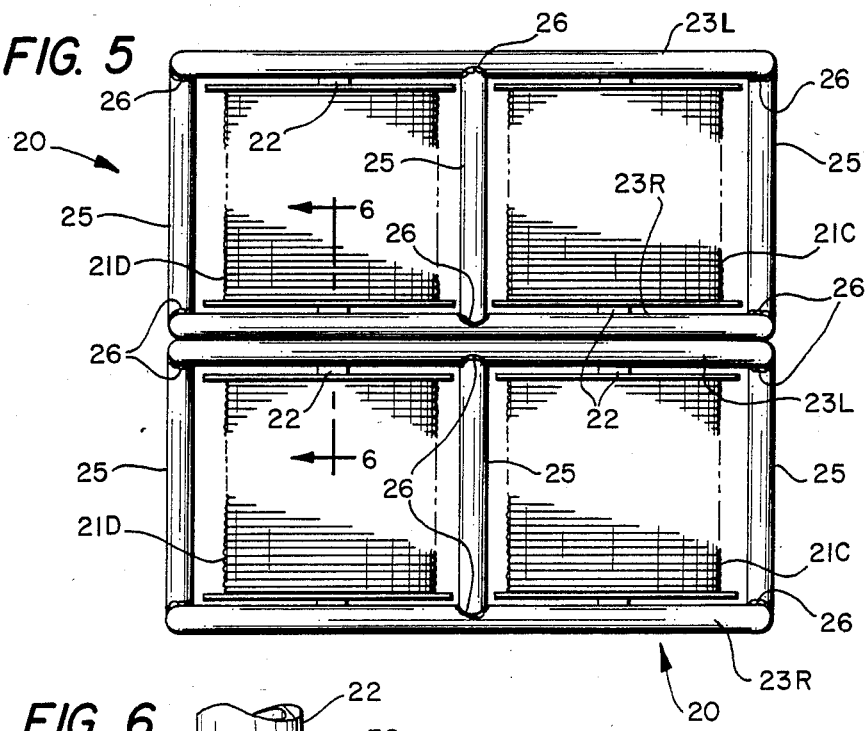
Figure 6:
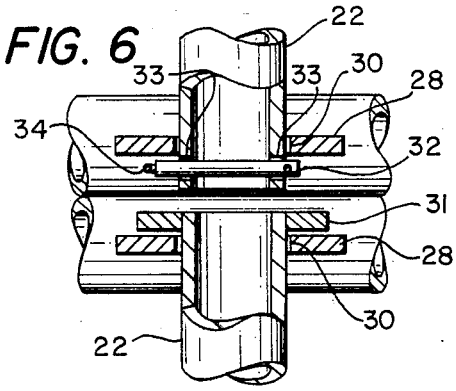
Figure 7:
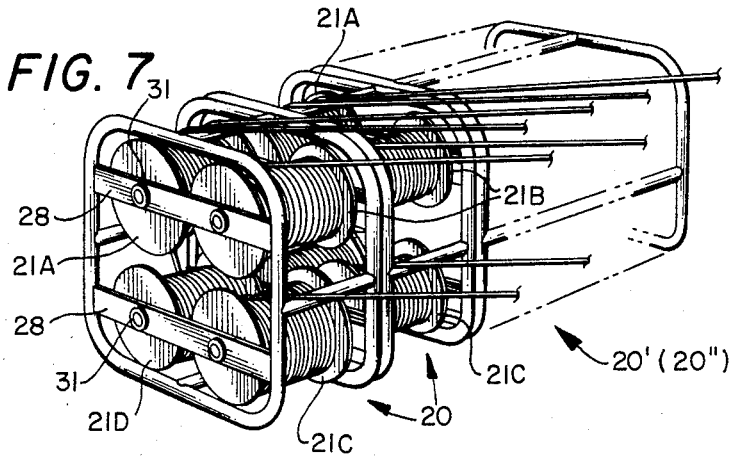
Figure 8:
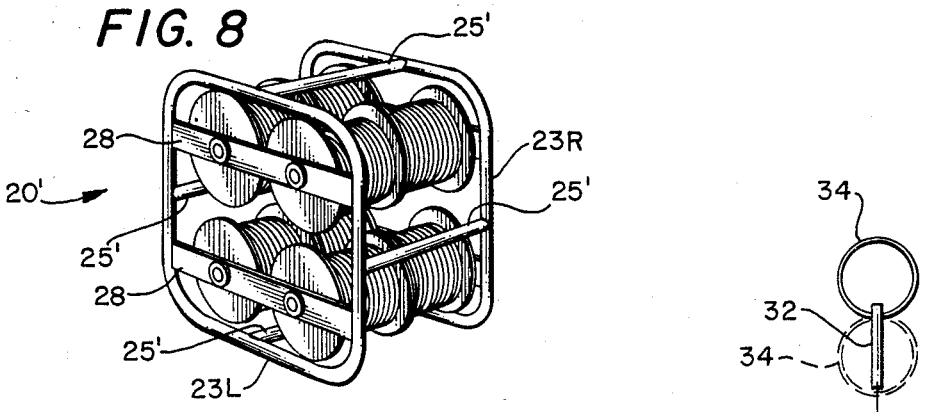
Figure 9:
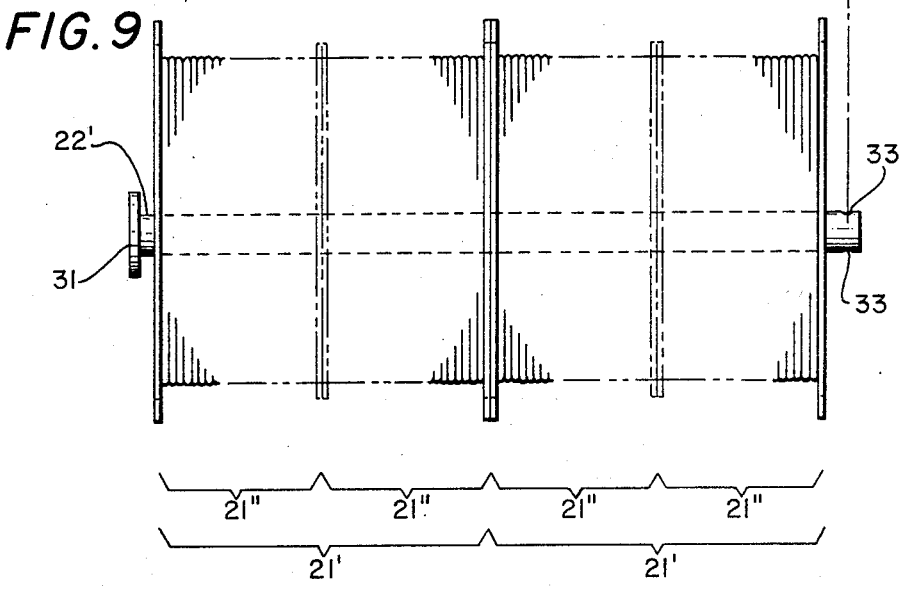
Figure 10:
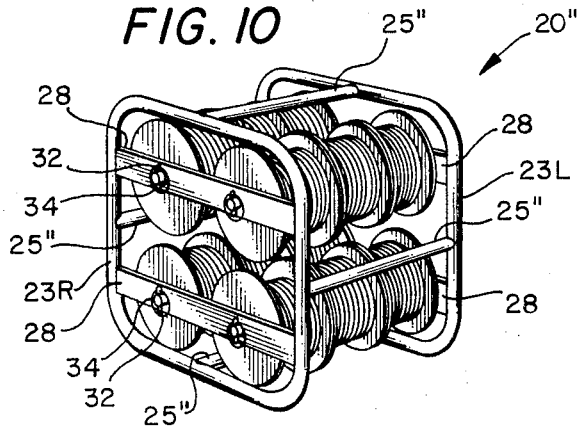

In the drawings:

FIG. 1 represents a perspective view of a four wire spool carrying wire dispensing spool protective holder;

FIG. 2, a side elevation of the end of the four wire spool holder and dispenser of FIG. 1 showing detail of a rectangular support frame member and that the four spools are entirely within the projected protective profile thereof;

FIG. 3, a rear elevation view of the four wire spool holder of FIGS. 1 and 2;

FIG. 4, a partial section view taken along line 4—4 of FIG. 2 showing wire spool mounting rod detail;

FIG. 5, a view showing two wire spool holder and dispensers stacked vertically;

FIG. 6, a partial section view taken along line 6—6 of FIG. 5 showing how the wire spool holder and dispenser units can be stacked;

FIG. 7, a perspective view of multiple wire spool holder units set up side by side for wire pulling;

FIG. 8, a perspective like FIG. 1 of an eight wire spool wire dispensing spool protective holder with eight wire spools held by the holder;

FIG. 9, a view showing a rod removed with two spools in full outline and alternately four spools in phantom along with key pin and retainer ring detail; and FIG. 10, a perspective like FIGS. 1 and 8 with three spools on each rod.

Referring to the drawings:

The wire dispensing multi-spool holder 20 of FIGS. 1–3 carries four wire spools 21A, 21B, 21C, and 21D all rotatably mounted on wire spool mounting rods 22 that are interchangeably alike. The wire dispensing multi-spool holder 20 has duplicate opposite side spaced parallel generally rectangular support frame members 23L and 23R formed of strong tubing and having rounded corners 24. The generally rectangular support frame members 23L and 23R are aligned and are structurally interconnected by four transverse spacing bars 25 welded 26 at opposite ends to the middle of the respective sides 27 of the support frame members 23L and 23R. The holder 20 with rounded corners 24 may be easily turned to rest with any one of its four edge sides resting on a support surface with one of the four sets of sides 27 of the support frame members 23L and 23R resting on the support surface. This may be accomplished without any of the four wire spools 21A, 21B, 21C and 21D coming into contact with the surface the holder 20 is resting on since none of the spools 21 extend beyond the transverse outer profile defined by the generally rectangular support frame members 23L and 23R.

Flat stock plank like members 28, two in each of the support frame members 23L and 23R, thinner than the diameter of the tubing of the frame members 23L and 23R span the space between two opposite sides 27 thereof in spaced parallel relation and are welded 29 to the transverse thickness middle of the frame member tubing. The comparative thickness of flat stock plank like members 28 to frame member 23 tubing is typically $\frac{1}{8}$ inch thick stock welded to $\frac{3}{4}$ inch diameter tubing in frame members 23. The two flat stock plank members 28 in spaced parallel coplanar relation in each rectangular (except for rounded corners 24) support frame member 23 are each provided with two spaced openings 30 to receive and support respective ends of wire spool 21 mounting rods 22 spanning the space between flat stock plank like members 28 aligned therebetween in the spaced parallel opposite side rectangular support frame members 23L and 23R. This provides for four wire spool 21 mounting rods 22 to be supported in spaced parallel relation such that wire spools 21 mounted thereon up to spool diameters the wire dispensing multi-spool holder 20 is designed to mount are supported between the opposite side rectangular support frame members 23L and 23R and advantageously entirely within the transverse outer projected protective profile thereof. This is an important feature in the wire dispenser 20 providing protection for wire and spools from damage to wires or breakage of spools during storage or during transporting of the wire dispensers, or during wire dispensing use of the wire dispensers 20.

Referring also to FIG. 4, each wire spool 21 mounting rod 22 is provided with a pressed on washer 31 (or flange) at one end and with an easily disengageable locking pin 32 that is inserted through rod tube openings (with rods 22 being in the form of tubes) at the other end for convenient removal of empty spools and replacement mounting of full wire spools on the spool mounting rods 22 as required. Further, the washer 31 (or flange) at one end of each wire spool 21 mounting rod 22 is thinner than the dimension from the outer face of the adjacent flat stock plank like memer 28 and the outermost extent of the respective side rectangular support frame member 23. In addition the locking pin 32 is so dimensioned and the rod tube end openings 33 so positioned that projection of the wire spool 21 mounting rod 22 tube at the locking ring end is less than the dimension from the outer face of the adjacent flat stock plank like member 28 and the outermost extent of the respective side rectangular support frame member 23. Thus, such rod 22 end dimensioning permits vertical stacking of two wire dispensers 20, as shown in FIG. 5, or more than two wire dispensers 20. This is accomplished without any rod 22 end to end interference with clearance as shown in FIG. 6. Such rod 22 end clearance also permits multiple wire spool holders 20 to be set side by side, as shown in FIG. 7, for wire pulling. Additional multiple wire spool holders such as the elongated holder 20' of FIGS. 8 and 9 and or the elongated holder 20" of FIG. 10 could also be set side by side as may be required for multiple wire pulling such as the 20'–21" section indicated partially in phantom in FIG. 7. The A, B, C and D wires being pulled from the wire dispensing multi-spool 21 holder 20 may be wires ranging from No. 22 to No. 10 wires from 500 foot wire spools up to seven inches in diameter mounted in a holder 20 that is lightweight yet strong weighing only seven pounds empty. The holders 20 still relatively light even when loaded with full wire spools 21 is quick to set up and smooth operating while protecting wire from damage and spools from breakage.

The wire dispensing multi-spool holder 20' of FIG. 8 is shown as an eight wire spool wire dispensing spool protective holder with the transverse spacing bars 25' and the rods 22' lengthened to accomodate the increased width between the duplicate opposite side spaced parallel rectangular support frame members 23L and 23R with other components otherwise the same as with the holder 20 embodiment of FIGS. 1–3 and are numbered the same. The locking pin 32 as detailed in FIG. 9 is shown to include a retaining ring 34 that is flipped from a pin inserted position retaining state indicated in phantom to a release state.

The wire dispensing multi-spool holder 20" of FIG. 10 is even wider between support frame members 23L and 23R than with holder 20' of FIG. 8 to accomodate twelve wire spools 21. The transverse spacing bars 25" and the wire spool mounting rods 22" are lengthened to accomodate the increased width between the support frame members 23L and 23R with other components otherwise the same as with the holder 20 embodiment of FIGS. 1–3 and are numbered the same. Obviously wire spool configurations may be altered from the wire spools 21 shown and still, within reason, as indicated, typically in FIG. 9 be mounted in various embodiments of the wire dispensing multi-spool holder presented.

In the various embodiments the transverse spacing bars 25, 25' and 25" are useful, in addition to being structural spacing elements between support frame members 23L and 23R, as guide support elements for wires being pulled. As shown in FIGS. 1–3 and with particular reference to FIG. 2 wire A being pulled from wire spool 21A is passed over the top bar 25, wire B from spool 21B is pulled directly, wire C from spool 21C is pulled over the front bar 25, and wire D from spool 21D is pulled around the rear bar 25 and up over the top bar 25. While wire D may ride over wire in wire spool 21A the passage of the D wire around rear bar 25 and up over top bar 25 minimizes pressure therefrom on wire A in spool 21A and any likelyhood of entanglement therewith.

Whereas this embodiment has been described with respect to several embodiments thereof, it should be realized that various changes may be made without departure from the essential contributions to the art made by the teachings hereof.

I claim:

1. A wire dispensing multi-spool protective holder comprising: two duplicate aligned opposite side spaced parallel generally rectangular support tubular frame members with rounded corners; spacing bars welded at opposite ends to respective sides of the generally rectangular support tubular frame members; flat stock support means fastened to and spanning the space between two opposite sides of said generally rectangular support tubular frame members; a plurality of wire spool mounting rods mounted on and extending between the flat stock support means of one of said generally rectangular support tubular frame members and the flat stock support means of the other of said generally rectangular support tubular frame members; and with said plurality of wire spool mounting rods mounted in spaced parallel relation located such that all wire spools held in the structure that the multi-spool protective holder is designed to mount are held entirely within the transverse outer profile defined by the two duplicate aligned opposite side spaced parallel generally rectangular support tubular frame members that facilitate placement of the holder with any one of its side edges resting on a support surface.

2. The wire dispensing multi-spool protective holder of claim 1, wherein said flat stock support means fastened to and spanning the space between two opposite sides of each of said generally rectangular support tubular frame members are two flat stock plank like members with ends welded to the tubular frame members.

3. The wire dispensing multi-spool protective holder of claim 2, wherein said flat stock plank like members welded at the ends to the tubular frame members are thinner than the diameter of the tubing forming said rectangular support tubular frame members; and with said flat stock plank like members having spaced openings in each to receive and support respective ends of said plurality of wire spool mounting rods.

4. The wire dispensing multi-spool protective holder of claim 3, wherein each rod of said plurality of wire spool mounting rods has flange projection means at one end and locking pin receiver opening means at the other end; and a locking pin placeable in said locking pin receiving opening means.

5. The wire dispensing multi-spool protective holder of claim 4, wherein said flange projection means at one end of each wire spool mounting rod is less than the dimension from the outer face of each flat stock plank like member to the outermost extent of the respective side rectangular support frame member tubing.

6. The wire dispensing multi-spool protective holder of claim 5, wherein the length of rod end projection at the locking pin end beyond the outer face of the adjacent flat stock plank like member is less than the dimension from the outer face of each flat stock plank like member to the outermost extent of the respective side rectangular support frame member tubing.

7. The wire dispensing multi-spool protective holder of claim 6, wherein said locking pin for each rod is an easily disengageable retaining ring equipped locking pin for removal of empty spools and replacement mounting of full wire spools on the spool mounting rods as required.

8. The wire dispensing multi-spool protective holder of claim 6, wherein there are four wire spool mounting rods mounted in spaced parallel relation in the holder structure.

9. The wire dispensing multi-spool protective holder of claim 8, wherein said duplicate aligned opposite side spaced parallel generally rectangular support tubular frame members are generally square except for the rounded corners.

10. The wire dispensing multi-spool protective holder of claim 9, wherein said wire spool mounting rods are sufficiently long to mount more than one wire spool on each rod.

11. The wire dispensing multi-spool protective holder of claim 9, wherein said spacing bars are welded to the middle of each side of said rectangular support frame members in position for some spacing bars to act as a pull guide for wire being pulled from the wire dispensing multi-spool protective holder.

* * * * *